US011846477B2

(12) United States Patent
Clark et al.

(10) Patent No.: US 11,846,477 B2
(45) **Date of Patent: *Dec. 19, 2023**

(54) SMART FIREARM SAFETY DEVICE

(71) Applicant: Alarm.com Incorporated, Tysons, VA (US)

(72) Inventors: Colby Kevin Clark, Provo, UT (US); Robert Nathan Picardi, Herndon, VA (US); Matthew Daniel Correnti, Newtown Square, PA (US); Michael Kelly, Washington, DC (US); Stephen Scott Trundle, Falls Church, VA (US)

(73) Assignee: Alarm.com Incorporated, Tysons, VA (US)

( * ) Notice: Subject to any disclaimer, the term of this patent is extended or adjusted under 35 U.S.C. 154(b) by 92 days.

This patent is subject to a terminal disclaimer.

(21) Appl. No.: 17/509,441

(22) Filed: Oct. 25, 2021

(65) Prior Publication Data

US 2022/0113103 A1 Apr. 14, 2022

Related U.S. Application Data

(63) Continuation of application No. 16/887,020, filed on May 29, 2020, now Pat. No. 11,156,420.

(60) Provisional application No. 62/854,066, filed on May 29, 2019.

(51) Int. Cl.
*F41A 17/06* (2006.01)

(52) U.S. Cl.
CPC ..... *F41A 17/063* (2013.01); *F41A 17/066* (2013.01)

(58) Field of Classification Search
CPC ..... F41A 17/063; F41A 17/06
USPC ..... 42/70.07, 70.11, 70.01
See application file for complete search history.

(56) References Cited

U.S. PATENT DOCUMENTS

| | | | | |
|---|---|---|---|---|
| 6,823,621 | B2 | 11/2004 | Gotfried | |
| 7,116,224 | B2 * | 10/2006 | Mickler | F41C 33/06 340/568.1 |
| 8,166,693 | B2 | 5/2012 | Hughes et al. | |
| 8,819,979 | B2 * | 9/2014 | Kelly | F41A 17/54 42/70.07 |
| 10,132,113 | B2 * | 11/2018 | Stevenson | G07C 9/37 |
| 11,156,420 | B1 * | 10/2021 | Clark | F41C 23/16 |
| 2002/0032976 | A1 * | 3/2002 | Riener | F41A 17/063 42/70.11 |

* cited by examiner

*Primary Examiner* — Reginald S Tillman, Jr.
(74) *Attorney, Agent, or Firm* — Fish & Richardson P.C.

(57) ABSTRACT

Methods, systems, and apparatus, including computer programs encoded on a computer storage medium, are described for implementing a smart firearm safety device. The safety device attaches to a firearm having a trigger and a slot for receiving a magazine. The safety device includes a locking mechanism that attaches to the trigger to preclude depressing a trigger of the firearm and a sensor that determines an orientation of the firearm or a relative motion of the firearm to indicate detected movement of the firearm. The safety device also includes a radio device that receives parameter signals from the sensor indicating movement of the firearm. The radio device communicates with a component of a property monitoring system to receive a command to engage the locking mechanism to preclude depressing the trigger of the firearm based on parameter signals indicating a particular type of detected movement of the firearm.

20 Claims, 6 Drawing Sheets

SMART FIREARM SAFETY DEVICE

CROSS-REFERENCE TO RELATED APPLICATION

This application is a continuation of U.S. patent application Ser. No. 16/887,020, filed May 29, 2020, which claims the benefit of U.S. Patent Application Ser. No. 62/854,066, filed on May 29, 2019. The complete disclosures of all of the above patent applications are hereby incorporated by reference in their entirety for all purposes.

FIELD

This specification relates to electronic devices for securing items at a property.

BACKGROUND

Monitoring devices and sensors are often dispersed at various locations at a property, such as a home or commercial business. These devices and sensors can have distinct functions at different locations of the property. Some sensors at a property offer different types of monitoring and control functionality. The control functionality afforded by these sensors and devices can be leveraged to secure items at a property or to obtain information about items at respective properties that are located in certain rooms or areas of the property.

SUMMARY

This document describes techniques for implementing a smart firearm safety device that provides a modern solution for securing a "mobile" firearm. The safety device may be one of multiple components included in a property monitoring system for securing a property. The safety device includes a locking mechanism that is operable to prevent or substantially reduce a risk of unauthorized, or accidental, discharge of a firearm. The safety device also includes a radio component/device that is configured to communicate, e.g., wirelessly with other "smart" devices and components of the property monitoring system. The safety device is operable to provide alerts/notifications (e.g., in real-time), transmit "panic" signals to remote monitoring stations, prevent or deter theft of a firearm that includes the safety device, and provide resources and information that can assist in the recovery of stolen property.

One aspect of the subject-matter described in this specification can be embodied in a smart firearm safety device. For example, the device can be a safety device for attaching to a firearm that includes a trigger guard. The safety device includes a locking mechanism configured to attach to the trigger guard of the firearm to preclude depressing a trigger of the firearm. The safety device also includes a sensor that is operable to determine an orientation of the firearm or a relative motion of the firearm that indicates detected movement of the firearm. The device further includes a radio device operable to receive parameter signals from the sensor indicating movement of the firearm. The radio device communicates with a component of a property monitoring system to receive a command to engage the locking mechanism to preclude depressing the trigger of the firearm based on parameter signals indicating a particular type of detected movement of the firearm.

These and other implementations can each optionally include one or more of the following features. For example, in some implementations, the radio device interacts with the property monitoring system to generate a notification that is transmitted to a client device that communicates with the sensor by way of the property monitoring system; and the notification indicates the particular type of detected movement of the firearm.

In some implementations, the radio device includes a sensor component that transmits parameter signals to the property monitoring system for analysis at a monitoring server of the property monitoring system; and the monitoring server is configured to generate an alarm notification that is transmitted to the client device, wherein the alarm notification describes the particular type of detected movement of the firearm.

In some implementations, the radio device is operable to: receive an authorization command generated by the property monitoring system based on input received from a client device of a registered owner of the firearm; and engage the locking mechanism attached to the trigger guard of the firearm based on the authorization command, or disengage the locking mechanism attached to the trigger guard of the firearm based on the authorization command.

In some implementations, the safety device further includes a biometric scanning device that interacts with the radio device. The biometric scanning device is configured to: obtain data representing a biometric attribute of a registered owner of the firearm; and generate an authorization command based on the data representing the biometric attribute, wherein the authorization command is operable to engage or disengage the locking mechanism.

In some implementations, the biometric scanning device is further configured to: engage the locking mechanism attached to the trigger guard of the firearm based on a first authorization command; and disengage the locking mechanism attached to the trigger guard of the firearm based on a second authorization command that is different than the first authorization command. In some implementations, the locking mechanism is configured to be manually disengaged independent of the second authorization command for disengaging the locking mechanism.

In some implementations, the radio device is operable to: receive a first status signal indicating the locking mechanism has been disengaged; and in response to receiving the first status signal, transmit a second status signal to the property monitoring system to cause the property monitoring system to activate an alarm system at the property based on the locking mechanism having been disengaged; and in response to receiving the first status signal, transmit a third status signal to the property monitoring system to cause the property monitoring system to alert emergency personnel based on the locking mechanism having been disengaged.

One aspect of the subject matter described in this specification can be embodied in a method implemented using a smart firearm safety device. The method includes determining, using a sensor, an orientation of a firearm or a relative motion of the firearm that indicates detected movement of the firearm; receiving, by a radio device, parameter signals representing sensor data generated by the sensor and indicating movement of the firearm, wherein the radio device is operable to communicate with a component of a property monitoring system; providing, by the radio device, sensor data to the component of the property monitoring system for analysis at the component; and receiving, by the radio device, a command to: engage a locking mechanism attached to the firearm to preclude a user from depressing a trigger of the firearm based on the sensor data indicating a particular type of detected movement of the firearm; or disengage the locking mechanism attached to the firearm to permit a registered owner of the firearm to depress the trigger of the firearm.

These and other implementations can each optionally include one or more of the following features. For example, in some implementations, receiving the command comprises: receiving an authorization command generated by the property monitoring system based on input received from a client device of a registered owner of the firearm; and engaging the locking mechanism attached to a trigger guard of the firearm based on the authorization command, or disengaging the locking mechanism attached to the trigger guard of the firearm based on the authorization command.

Other implementations of this and other aspects include corresponding systems, apparatus, and computer programs, configured to perform the actions of the methods, encoded on computer storage devices. A computing system of one or more computers or hardware circuits can be so configured by virtue of software, firmware, hardware, or a combination of them installed on the system that in operation cause the system to perform the actions. One or more computer programs can be so configured by virtue of having instructions that, when executed by data processing apparatus, cause the apparatus to perform the actions.

BRIEF DESCRIPTION OF THE DRAWINGS

Like reference numbers and designations in the various drawings indicate like elements.

DETAILED DESCRIPTION

A property, such as a house or a place of business, can be equipped with a monitoring system to enhance the security of the property. The property monitoring system may include one or more sensors, such as motion sensors, camera/digital image sensors, or temperature sensors, distributed about the property to monitor conditions at the property. In many cases, the monitoring system also includes a control unit and one or more controls, which enable automation of various actions at the property, such as setting a thermostat, engaging or disengaging mechanisms for securing certain items at the property, or triggering actions or commands to arm or disarm a security system at the property.

In this context, techniques are described for a firearm safety device with features for securing a firearm and a computing system that enables engaging or disengaging certain features of the safety device. For example, components and devices of the computing system can be included at the firearm safety device to engage or disengage a locking mechanism of the safety device. In some implementations, the described techniques are used to implement a "smart" firearm safety device for securing a "mobile" firearm by activating a mechanism attached to the firearm to preclude inadvertent discharge of the firearm. For example, the firearm safety device includes a locking mechanism that is operable to prevent or substantially reduce a risk of unauthorized, or accidental, discharge of a firearm.

Figure 1:
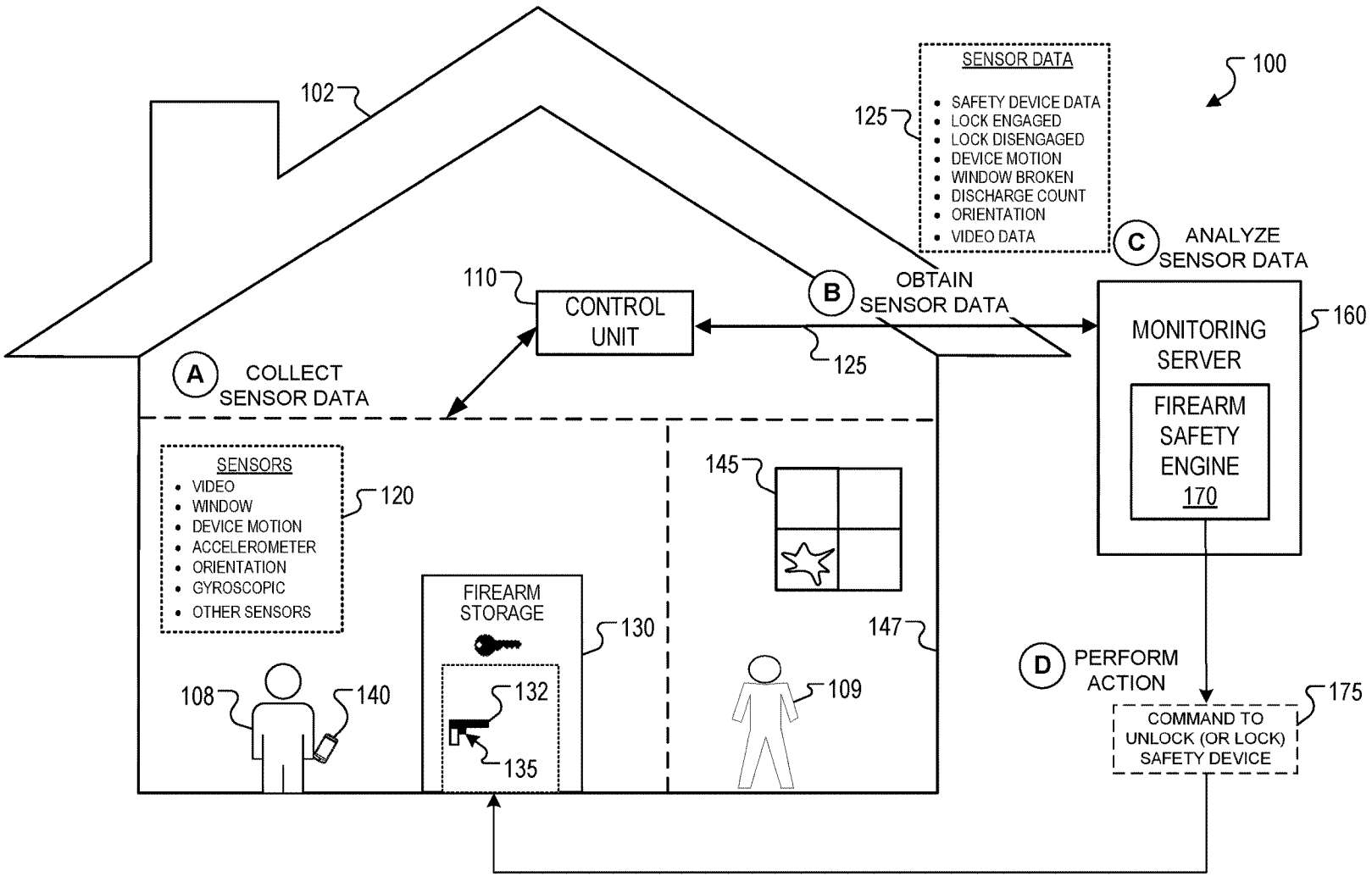
FIG. 1 shows a block diagram of a computing system comprising a property monitoring system for securing items at a property.

FIG. 1 shows a block diagram of an example computing system 100 that can be used to perform one or more actions for securing a firearm or other related items at a property 102. The property 102 may be, for example, a residence, such as a single family home, a townhouse, a condominium, or an apartment. In some examples, the property 102 may be a commercial property, a place of business, or a public property, such as a police station, fire department, or military installation.

The system 100 can include multiple sensors 120. Each sensor 120 can be associated with various types of devices that are located at property 102. For example, a sensor can be associated with a video or image recording device located at the property 102, such as a digital camera or other electronic recording device. Similarly, a sensor(s) can be associated with safety devices and mechanisms that control the activation or deactivation of functions for securing items such as firearms at the property 102. As described above, the property 102 is monitored by a property monitoring system. The property monitoring system includes a control unit 110 that sends sensor data 125 obtained using sensors 120 to a remote monitoring server 160. In some implementations, the property monitoring systems and monitoring servers 160 described herein are sub-systems of system 100.

Monitoring server 160 includes a firearm safety engine 170 (described below) that is configured to detect movement of a firearm at the property 102 and to trigger one or more actions relating to the security or safe operation of the firearm at the property 102. The monitoring server 160 is configured to pull or obtain new sensor data 125 from one or more sensors 120 and to use the firearm safety engine 170 to analyze the new data. In response to analyzing the new data, the monitoring server 160 may detect the occurrence of an action involving the firearm. The monitoring server 160 can determine that the detected action warrants engaging or disengaging one or more features of a safety device 135 (described below) attached to the firearm 132.

Each of the sensors 120 can use various types of technology to transmit sensor signal data or to exchange data communications with devices of system 100 (or the property monitoring system). In some implementations, one or more sensors 120 at the property 102 can be at least one of: a Z-Wave enabled sensing device, a Bluetooth enabled sensing device, a Wi-Fi enabled sensing device, or a sensing device that uses radio or wireless signal technology. Additional sensor features are described in more detail below.

The property monitoring system and the control unit 110 can be located at the property 102 or at a remote location relative to a location of the property 102. In some implementations, the control unit 110 is located at the property 102, while other units and devices that form the property monitoring system are located at a remote location.

The sensors 120 generate sensor data 125 describing various types of sensed activity at the property 102. For example, the sensors 120 can be one or more of a motion sensor, gyroscopic sensor, an accelerometer, a special-purpose sensor, or various other types of sensors configured to sense certain conditions, statuses, or activities at the property 102. In some implementations, at least a subset of the sensors 120 are configured to detect movement of a firearm 132 stored at the property 102. For example, at least one sensor 120 is an accelerometer, orientation, or motion sensor installed at the safety device 135 to detect particular types of movement of the firearm.

Sensor data 125 can describe sensed activities such as whether a lock feature of the safety device 135 is engaged or disengaged, detected motion of the firearm 132 or tampering of the safety device 135, or whether a window at the property 102 is open, closed, or damaged (e.g., window glass being shattered or broken). Sensor data 125 can also describe sensed activities such as a relative orientation of the firearm 132, image or video data of a user handling the firearm 132 or other items at the property 102, or an amount of times the firearm 132 was discharged or fired. The sensor data 125 can also provide general information about the firearm 132 and safety device 135, such as a location or lock status of the firearm 132 or remaining charge of a battery installed at the safety device 135.

Control unit 110 can be located at the property 102 and may be a computer system or other electronic device configured to communicate with the sensors 120 to cause various functions to be performed for the property monitoring system or system 100. The control unit 110 may include a processor, a chipset, a memory system, or other computing hardware. In some cases, the control unit 110 may include application-specific hardware, such as a field-programmable gate array (FPGA), an application-specific integrated circuit (ASIC), or other embedded or dedicated hardware. The control unit 110 may also include software, which configures the unit to perform the functions described in this document.

In some implementations, a user 108 communicates with the control unit 110 through a network connection, such as a wired or wireless connection. As indicated above, the user can be a property owner, security manager, property manager, or occupant/resident of the property 102. In some implementations, the property owner or user 108 communicates with the control unit 110 through a software ("smart home") application installed on their mobile device 140. The control unit 110 can perform various operations related to the property 102 by sending commands to one or more of the sensors 120 at the property 102.

For example, the control unit 110 can activate a camera, lock or unlock a door/window, activate/arm an alarm system, de-activate/de-arm the alarm system, power on or off a light at the property 102, or engage or disengage a locking mechanism of a firearm 132. As described in more detail below, the user 108 can use mobile/client device 140 to interact with the smart home application and provide commands to the sensors 120, via the control unit 110, to perform the various operations described in this document.

The sensors 120 can receive, via network 105, a wireless (or wired) signal that controls operation of each sensor 120. For example, the signal can cause the sensors 120 to initialize or activate to sense activity at the property 102 and generate sensor data 125. The sensors 120 can receive the signal from monitoring server 160 or from control unit 110 that communicates with monitoring server 160, or from the firearm safety engine 170 accessible by the monitoring server 160. In addition to detecting and processing wireless signals received via network 105, the sensors 120 can also transmit wireless signals that encode sensor data 125 describing an orientation or movement of a firearm.

The monitoring server 160 receives and analyzes the sensor data 125 encoded in wireless signals transmitted by the sensors 120. For example, the monitoring server 160 analyzes the sensor data 125 encoded in the wireless signals to determine a status or condition of an item that is used by a person at the property. The item can be a known household or commercial property item, such as windows, doors, vehicles, physical structures, mobile structures, firearms 132, weapons, or other related items typically located at a property. The monitoring server 160 performs various functions relating to analyzing or monitoring video and image data as well as other sensor parameter values included in the sensor data 125.

Property 102 can include a firearm storage structure 130 for storing a firearm 132. Some conventional physical safes or storage elements can be expensive and may be perceived by users or owners of firearms as unwanted obstacles during emergencies. This can lead the owner to secure firearms or related weapons by other means, such as by hiding the firearms in locked bedroom drawers. Although such methods can allow for easier access to a firearm, these alternative security measures are error prone and easily discoverable by minors and persons that are not authorized to operate the firearm.

The firearm storage structure 130 represents a streamlined storage structure that includes electronic and signal processing devices for integrating or communicating with components of the property monitoring system. For example, storage structure 130 can be a "smart" storage structure that receives commands and other signals for locking or unlocking the storage structure 130 to provide access to the firearm 132 stored in the structure 130. In some implementations, the signal processing devices of the storage structure 130 are operable to interact with communication devices of the firearm safety device 135 so that a locking mechanism of the safety device automatically disengages when the storage structure 130 is unlocked.

FIG. 1 includes stages A through D, which represent a flow of data. In stage (A), each of the one or more sensors 120 generate sensor data 125 including parameter values that describe different types of sensed activity at the property 102. In some implementations, the control unit 110 (e.g., located at the property 102) collects and sends the sensor data 125 to the remote monitoring server 160 for processing and analysis at the monitoring server.

In some implementations, the firearm safety device 135 interacts with a property monitoring system to provide an additional "sensor" that is operable to trigger an alarm event. For example, firearm safety device 135 can be attached to a firearm 132 that is stored in a home owner's bedroom for use during an emergency. In some cases, a break in occurs and is detected by the home security system. For example, an intruder 109 may unlawfully enter the property 102 by shattering a glass portion of window 145 in a room 147 that is located at another section of the property 102. Security/window sensors at the property 102 may be configured to detect this particular type of unlawful entry and the property monitoring system may alert a monitoring station about the presence of the intruder 109.

The property monitoring system sends a command 175 to the safety device 135 in response to detecting the unlawful entry. For example, a home security system can send a signal to disengage a locking mechanism (described below) of the safety device 135. The signal can represent command 175 and may be sent by the security system in response to the system detecting that intruder 109 has unlawfully entered the property, is attempting to burglarize the property 102, or both. The command 175 can automatically disengage the locking mechanism so the user/owner 108 of the firearm is able to quickly access the firearm 132 without the need for additional unlocking before the firearm 132 is ready for use.

In alternative implementations, security sensors at the property 102 may not be configured to detect this particular type of unlawful entry, so the property monitoring system may remain unaware of the intruder 109. However, the user 108, e.g., a registered owner of the firearm 132, may be aware of the forced entry perpetrated by intruder 109. The user 108 retrieves the firearm 132 with the safety device 135 attached and manually disengages a locking mechanism of the safety device 135. The safety device 135 transmits a signal representing sensor data 125 to the monitoring server 160 for analysis at the firearm safety engine 170.

In stage (B), the monitoring server 160 receives or obtains sensor data 125 from the control unit 110. As discussed above, the monitoring server 160 can communicate electronically with the control unit 110 through a wireless network, such as a cellular telephony or data network, through any of various communication protocols (e.g., GSM, LTE, CDMA, 3G, 4G, 5G, 802.11 family, etc.). In some implementations, the monitoring server 160 receives or obtains sensor data 125 from the individual sensors rather than from control unit 110.

In stage (C), the monitoring server 160 analyzes the sensor signal data 125 and/or other property data received from the control unit 110 or directly from sensors/devices 120 located at the property 102. As indicated above, the monitoring server 160 analyzes the sensor data 125 to determine whether a locking mechanism integrated at a safety device 135 for items at the property 102 should be engaged or disengaged. The monitoring server 160 can analyze sensor data 125 to detect forced entry at the property 102, to detect shattering of window 145 at the property 102, to detect movement of intruder 109 at the property 102, or a combination of each.

The monitoring server 160 can also use the firearm safety engine 170 to analyze sensor data 125 to detect movement of a firearm 132 at the property 102. For example, the senor data 125 represented by the signals transmitted by the safety device 135 is analyzed at the safety engine 170 based on the user 108 having retrieved the firearm 132 after detecting the presence of intruder 109 at the property 102. The monitoring server 160 determines that the locking mechanism of the safety device 135 has been disengaged based on analysis performed by the safety engine 170.

Based on the data analysis, in stage (D), the monitoring server 160 performs various actions. For example, the monitoring server 160 sends command 175 to unlock the safety device 135 in response to the security system detecting that intruder 109 has unlawfully entered the property or is burglarizing the property 102. The command 175 can unlock the safety device 135 by automatically disengaging the locking mechanism so the user/owner 108 can quickly access the firearm 132 without being required to perform additional unlocking steps before the firearm 132 is ready for use.

Alternatively, in response to the security system determining that the locking mechanism has been disengaged (e.g., manually disengaged by user 108), the monitoring server 160 can transmit one or more commands 175 to activate an alarm system at the property 102 and to alert emergency personnel. In general, the monitoring server 160 can use results of analysis performed at the safety engine 170 to trigger one or more actions relating to the security of user 108 or safe operation of a firearm 132 at the property 102. For example, the monitoring server 160 can transmit commands to automatically unlock or disengage a locking mechanism of the firearm 132 to ensure the user 108 can quickly and safely operate the firearm 132 in case of an emergency.

In some implementations, the user/registered owner 108 uses client device 140 to communicate with the monitoring server 160 to disable alerts generated by the safety device 135 attached to a firearm 132 that the user is carrying to a shooting range. While at the shooting range the owner 108 can use client device 140 to communicate with the monitoring server 160 to transmit a command to disengage the locking mechanism of the safety device 135 to enable normal discharge functions of the firearm 132.

Though the stages are described above in order of (A) through (D), it is to be understood that other sequencings are possible and disclosed by the present description. For example, in some implementations, the monitoring server 160 may receive sensor data 125 from the control unit 110 that includes both sensor status information and usage data 126 for each sensor 120. In some cases, aspects of one or more stages may be omitted. For example, in some implementations, the monitoring server 160 may receive and/or analyze sensor data 125 that includes only usage information rather than both sensor status information and usage data.

Figure 2:
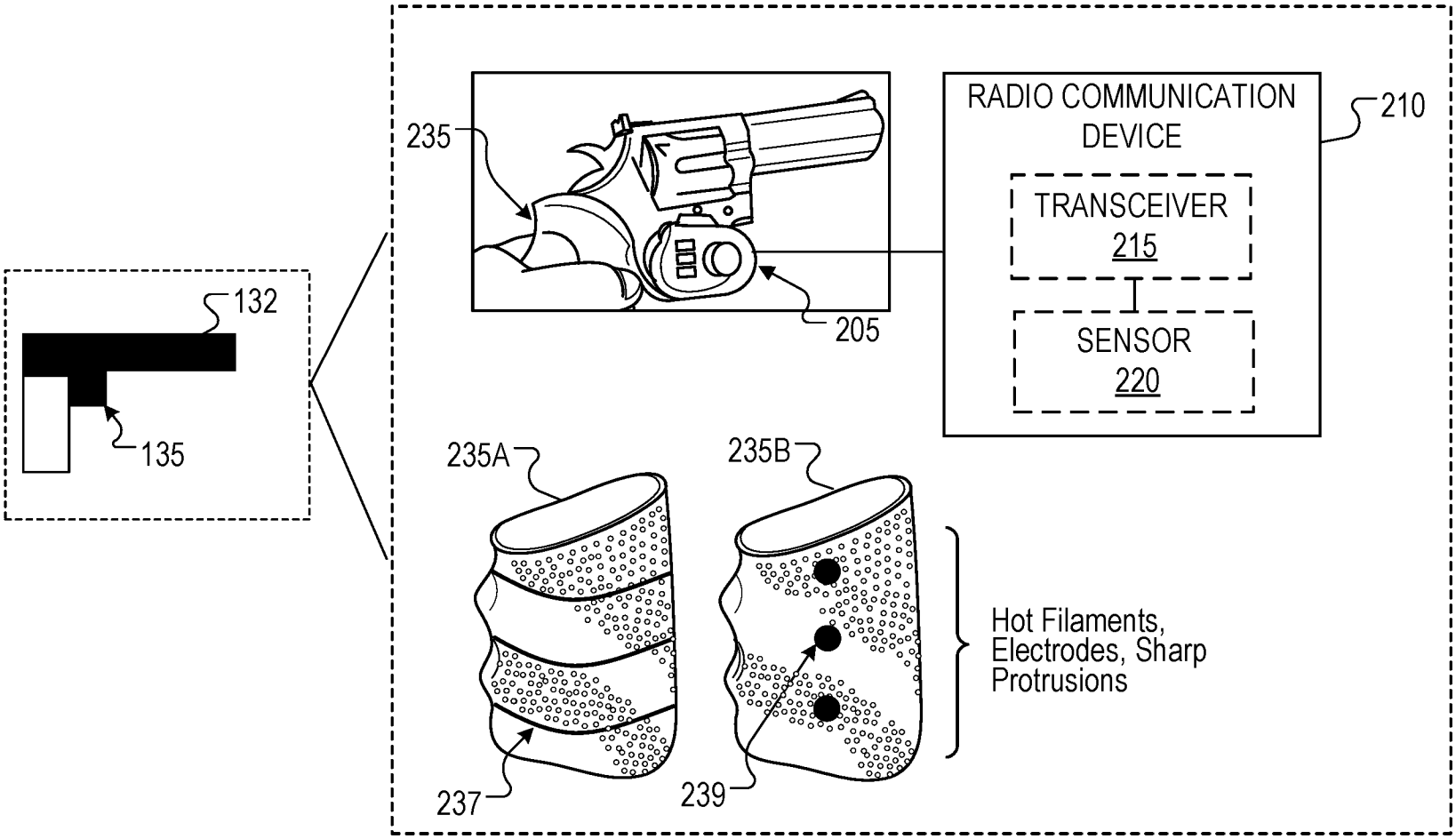
FIG. 2 illustrates an example firearm safety device for attaching to a firearm at a property.

FIG. 2 illustrates an example firearm safety device 135 for attaching to a firearm 132 at a property 102. The firearm safety device 135 includes a locking mechanism 205 and a radio communication device 210 ("radio device 210"). In some implementations, radio device 210 is an example sensing device that includes a transceiver for i) transmitting sensor data generated using a sensing element or sensor of the sensing device or ii) receiving commands for controlling various functions of the radio/sensing device 210.

The locking mechanism 205 can include one or more features relating to an example trigger lock. In some implementations, the locking mechanism 205 is a firearm trigger locking device that includes an example electronic actuator or solenoid lock for engaging the locking mechanism 205 to preclude discharging the firearm 132 or for disengaging the locking mechanism 205 to enable discharging the firearm 132. For example, the actuator or solenoid can be used to engage or disengage the locking mechanism 205 in response to receiving an electrical signal, e.g., from the radio device 210, the control unit 110, or another component of the property monitoring system.

The locking mechanism 205 can be configured for coupling or attaching to a firearm (e.g., a handgun or pistol) at a section of the firearm that includes the trigger and/or a trigger guard. For example, the locking mechanism 205 at least partially attaches to the firearm 132 at a section of the firearm 132 that is between the trigger and the trigger guard. In some implementations, the firearm safety device 135 attaches to the firearm's trigger guard and prevents access to the firearm's trigger to prevent the trigger from being depressed (intentionally or accidentally depressed), and thus prevents the firearm 132 from discharging. In some cases the firearm includes a trigger guard. In some other cases the firearm does not include a trigger guard and the locking mechanism 205 is configured for coupling to another part of the firearm to prevent access to the firearm's trigger and preclude depressing of the trigger.

The safety device 135 can be configured for mobile or remote disablement of a firearm 132 when the safety device is attached to the firearm. For example, the safety device 135 can include one or more electrical and/or mechanical mechanisms that are capable of disabling a discharge function of the firearm 132 or otherwise rendering the firearm 132 unusable. In some implementations, these mechanisms can be triggered automatically, or manually, through an application program installed on the client device 140 that communicates with the property monitoring system.

The safety device 135 can be configured to render firearm 132 incapable of firing or discharging when a particular type of command is provided to the safety device 135. For example, the safety device 135 can be embedded (rather than retrofitted) at the firearm 132 to create one or more mechanical disruptions that inhibit discharging the firearm 132 in response to receiving a firearm disable command or a related command to engage the locking mechanism 205. In some implementations, the locking mechanism 205 includes an extendable metal prong, such as an example device that extends a short metal element into a magazine holder, chamber, or trigger portion of firearm 132. The extendable metal prong is operable to cause mechanical disruptions that block normal operation of the firearm 132 to render the firearm incapable of discharging when a disable command is received at the safety device 135.

The safety device 135 can include a foam capsule that is configured to render the firearm 132 incapable of firing or discharging in response to receiving a disable command from a client device 140 or the property monitoring system. For example, the foam capsule can be a micro-capsule containing chemicals for creating a foam substance (e.g., a hard foam substance) at the firearm 132. The foam capsule can be tethered by a small wire to the safety device 135. In some implementations, the capsule adheres to the firearm 132 at an example location that is adjacent to the trigger, behind the trigger, or in-between the trigger and the trigger guard. The safety device 135 is operable such that the foam capsule ruptures in response to receiving an electrical signal, e.g., generated by radio 210 and having a specific voltage and current. Once ruptured the foam capsule releases a foam substance that rapidly hardens, blocks or inhibits normal operation of the firearm 132, and renders the firearm incapable of being discharged.

The safety device 135 could also be constructed, designed, or otherwise structured in a manner that is similar to example cable locks that run through the action of a firearm, down through the magazine well, and circle back around to form a loop. Such a safety device 135 can be configured to lock in place when attached to a firearm 132 and, thus, prevent the insertion of a magazine and also prevent the firearm's action from completely closing. In some implementations, the safety device 135 includes other components which enable it to serve as more than a simple locking mechanism.

The radio device 210 can be a wireless radio, such a as category-M (Cat-M) device that includes an LTE chipset for exchanging data and signal communications with components of the property monitoring system. The radio device 210 generally includes a transceiver 215 and a sensor 220. The transceiver 215 is operable to transmit parameter signals generated by the sensor 220 and to receive commands for controlling safety features and locking functions of the firearm safety device 135. For example, the commands can be processed by the radio device 210 to control an example actuator of the locking mechanism 205 to engage or disengage the locking mechanism.

The sensor 220 can correspond to one or more of the sensors 120 described above. Similarly, the parameter signals generated by sensor 220 can represent sensor data corresponding to the sensor data 125 described above. In some implementations, the sensor 220 is a gyroscopic sensor, such as an angular velocity sensor, that is operable to detect a physical orientation of a firearm 132 based at least on a sensed angular velocity of the firearm when the sensor 220 is attached to the firearm. In other implementations, the sensor 220 is an accelerometer that is operable to detect a relative motion of the firearm when the sensor 220 is attached to the firearm.

For example, the sensor 220 may be an accelerometer structured as a compact device that includes a sensing element designed to measure non-gravitational acceleration. When the sensor 220 is integrated in the safety device 135 at firearm 132 and the firearm moves from a standstill to any velocity indicating movement, the accelerometer sensor 220 is operable to respond to vibrations associated with such movements. For example, the sensor 220 responds by generating parameter signals representing sensor data that indicate particular types of detected movement of the firearm 132. The accelerometer sensor 220 can be disposed, placed, or otherwise located on, or substantially adjacent to, a handle/grip of the firearm 132.

In addition to radio communications device 210, the safety device 135 can also include other radio frequency devices that have signal processing capabilities relating to WiFi, GPS, or LTE so that a registered owner of the firearm 132 can track a location of the firearm 132 attached to the safety device 135 if the firearm 132 is stolen or misplaced.

The sensor 220 is operable to collect location and usage data about firearm 132, such as a detected number of times the firearm was discharged and an approximate location of the discharge. For example, the sensor 220 can use one or more sensing elements associated with gyroscopic or accelerometer functions of the sensor to generate parameter signals and values indicating distinct types of detected motion/movement of the firearm. In some implementations, the parameter values can indicate a particular type of movement that is consistent with the firearm being discharged. In other implementations, the sensor 220 is operable to detect a signature set of parameter values for determining when an action such as cocking/charging a bolt or handle occurs at the firearm 132, or when loading, unloading, or changing a magazine occurs at the firearm 132.

The safety device 135, including sensor 220, integrates with an existing security system installed at property 102. The safety device 135 can use the sensor 220 to detect the occurrence of a discharge event and communicate details associated with the discharge event to the security system or a related property monitoring system when a discharge event occurs. In some implementations, if the firearm 132 is discharged at or near property 102, e.g., a home or business, then the property monitoring system is operable to trigger one or more responses, such as activating security siren, notifying a central monitoring station, or alerting emergency personnel.

As described in more detail below, the sensor 220 can interact with the transceiver 215 of the radio device 210 to communicate, e.g., in real-time, with components of the property monitoring system, including a client device 140 assigned to a registered owner of the firearm 132. In some implementations, the sensor 220 is a biometric scanning device, such as a fingerprint scanner/reader, that interacts with the transceiver 215 of the radio device 210 to obtain, transmit, or process signal data representing biometric attributes of a user. For example, the sensor 220, e.g., a biometric scanning device, can be configured to: i) obtain data representing a biometric attribute (e.g., a finger print or iris/retina attribute) of a registered owner of the firearm; and ii) generate an authorization command based on analysis of the data representing the biometric attribute.

The authorization command is operable to engage (or disengage) the locking mechanism 205. The biometric scanning device represented by sensor 220 can be further configured to: i) engage the locking mechanism 205 when the firearm safety device 135 is attached to the firearm 132 based on a first authorization command; and ii) disengage the locking mechanism 205 attached to the firearm 132 based on a second authorization command that is different than the first authorization command. In some implementations, the safety device 135 attaches to a trigger guard of the firearm 132 or is attached to the firearm 132 via the trigger guard or locations adjacent to the trigger or trigger guard. In some implementations, the safety device 135 attaches to the firearm 132 at one or more other locations.

In some implementations, the locking mechanism 205 is configured to be manually disengaged independent of receiving an authorization command for disengaging the locking mechanism. For example, a registered owner of the firearm 132 can retrieve the firearm with the firearm safety device 135 installed at the firearm 132 and manually disengage the locking mechanism 205 by using a key, a fingerprint reader, a combination lock, a simple latch, or other methods related to these options for disengaging the locking mechanism 205.

The firearm safety device 135 can include a grip portion 235. The grip portion 235 can be embedded at a particular component of the firearm 132, such as a grip or barrel, or encased in an attachable accessory, such as a rubber grip sleeve or a laser grip sleeve. For example, the grip portion 235 can be secured or installed on the firearm 132 by way of an adhesive or epoxy substance that enables the grip portion to adhere to a handle or other section of the firearm 132. In some implementations, the grip portion 235 is part of a retrofitted removable accessory installed at the firearm 132. The safety device 135 is operable to: i) detect that the grip portion 235 has been removed from the firearm 133; and ii) transmit a signal to the property monitoring system or the client device 140 for generating an alert to indicate that the grip portion 235 is detached from the firearm 132. The alert can be used to inform the registered owner or emergency personnel that the firearm 132 is now unprotected.

The grip portion 235 is operable to disable the firearm 132 via disable command received from the client device 140 or the property monitoring system. In some implementations, the disable command inhibits a user's ability to handle the firearm 132 rather than disabling, or permanently disabling, the firearm's discharge functions. For example, the grip portion 235 can include at least two embodiments for inhibiting a user's ability to handle and ultimately discharge the firearm 132.

One embodiment is a grip portion 235A that includes one or more sharp protrusions 237. For example, the sharp protrusions 237 can be tiny shards of plastic or metal that are extendable or retractable at an exterior surface of grip portion 235A. The sharp protrusions 237 can be disposed in several small pores, grooves, or sections at a surface of the grip portion 235A. In some implementations, the safety device 135 is operable to reposition the sharp protrusions 237 outward, making a firm grip painful for an uncovered hand and inhibiting a user's ability to discharge the firearm 132.

Another embodiment is a grip portion 235B that includes one or more features 239 that can represent electrodes, filaments, or a combination of each. In some implementations, a voltage can be applied to small electrodes 239 in the grip portion 235B to disable the firearm 132 by inhibiting a user's ability to discharge the firearm 132. For example, the electrodes 239 are operable to generate a painful and/or debilitating shock to a human hand when the firearm 132 is gripped by the hand and irrespective of whether or not the hand is covered by a glove. In other implementations, the heat filaments 239 are represented by multiple wires (e.g., thin wires) that are embedded in, integrated in, or otherwise disposed on the grip portion 235B. The safety device 135 can receive a command or instruction to disable the firearm 132. In response to receiving the command, the radio device 210 and/or sensor 220 interact to generate a current through the heat filaments 239 represented by the multiple thin wires embedded in the grip portion 235B. The generated current causes the multiple wires to rapidly heat to a painful or debilitating temperature that severely inhibits a user's ability to grip or discharge the firearm 132.

The locking mechanism 205 can be a connected trigger lock that couples to radio device 210, sensor 220, or both. Based on this coupling, the connected trigger lock can be unlocked when the radio device 210 and/or sensor 220 senses or determines that the firearm 132 is within Bluetooth range of a client device. The device may be a client device 140 that is assigned to a registered owner of the firearm 132. In some implementations, if the radio device 210 and/or sensor 220 determines that the firearm 132 is outside Bluetooth range, then the safety device 135 may require that a manual override feature of the connected trigger lock, e.g., a combination code or key, be used to remove the lock.

In some implementations, the grip portion 235 is configured to include a heat sensor 220 or a force/compression sensor 220. The heat sensor 220 can be a thermal couple type device that is operable to detect heat applied to the grip portion 235 based on human contact with the grip portion. The force/compression sensor can be a strain gauge, force sensitive resistor, or related force sensing device that is operable to detect force applied to the grip portion 235 or compression of the grip portion 235 in response to force being applied to the grip portion 235. In some implementations, sensor data describing heat, compression, or electrical current at the grip portion 235, e.g., from human contact, is coupled or paired with accelerometer data to indicate when the firearm 132 is being moved in someone's hand.

In some implementations, the safety device 135 is geo-coded such that the locking mechanism can be disengaged only when the firearm 132 is within a predefined proximity of the property 102. For example, the predefined proximity can be no more than 100 or 200 hundred yards outside of a central location at the property 102. In one instance, the predefined proximity is a threshold proximity that is defined by an outer perimeter or boundary of a licensed gun range which corresponds to property 102. In some examples, the safety device 135 includes one or more geo-fence restrictions that are enabled in part by the radio device 210.

For example, system 100 can interact with the radio device 210 to establish one or more geo-fences at the property 102. Each geo-fence can define a geographic boundary or area where authorized use of the firearm 132 is permitted to occur. When the radio device 210 detects that the firearm 132 has been carried passed the boundary the safety device 135 is operable to engage the locking mechanism 205 to preclude discharging the firearm 132. In this manner discharging the firearm 132 can be automatically disabled upon exiting the authorized zone defined by the geo-fence boundary.

In some implementations, the safety device 135 is configured such that the locking mechanism 205 automatically disengages when a client device 140 assigned to the registered owner of the firearm 132 is within a threshold proximity of the safety device 135. For example, the safety device 135 includes the radio communication device 210 and the transceiver 215 for detecting and processing location signals transmitted by the client device 140. The radio device 210 can process the signals to determine that the client device 140 is within a threshold proximity of the safety device 135, e.g., within 10 feet of the safety device 135. The safety device 135 can also include a simple unlock mode that allows the client device 140 to disengage the locking mechanism in response to a single button press or based on a multi-digit code, such as a code that is fewer than or equal to five digits or a code that is more than five digits.

As discussed above, the monitoring server 160 includes a firearm safety engine 170. The firearm safety engine 170 is configured to processor sensor data generated by at least one sensor 120, 220 located at the property 102. The sensor 120, 220 may be integrated in a radio communication device 210 that forms a portion of the firearm safety device 135 that is attached to firearm 132.

Figure 3:
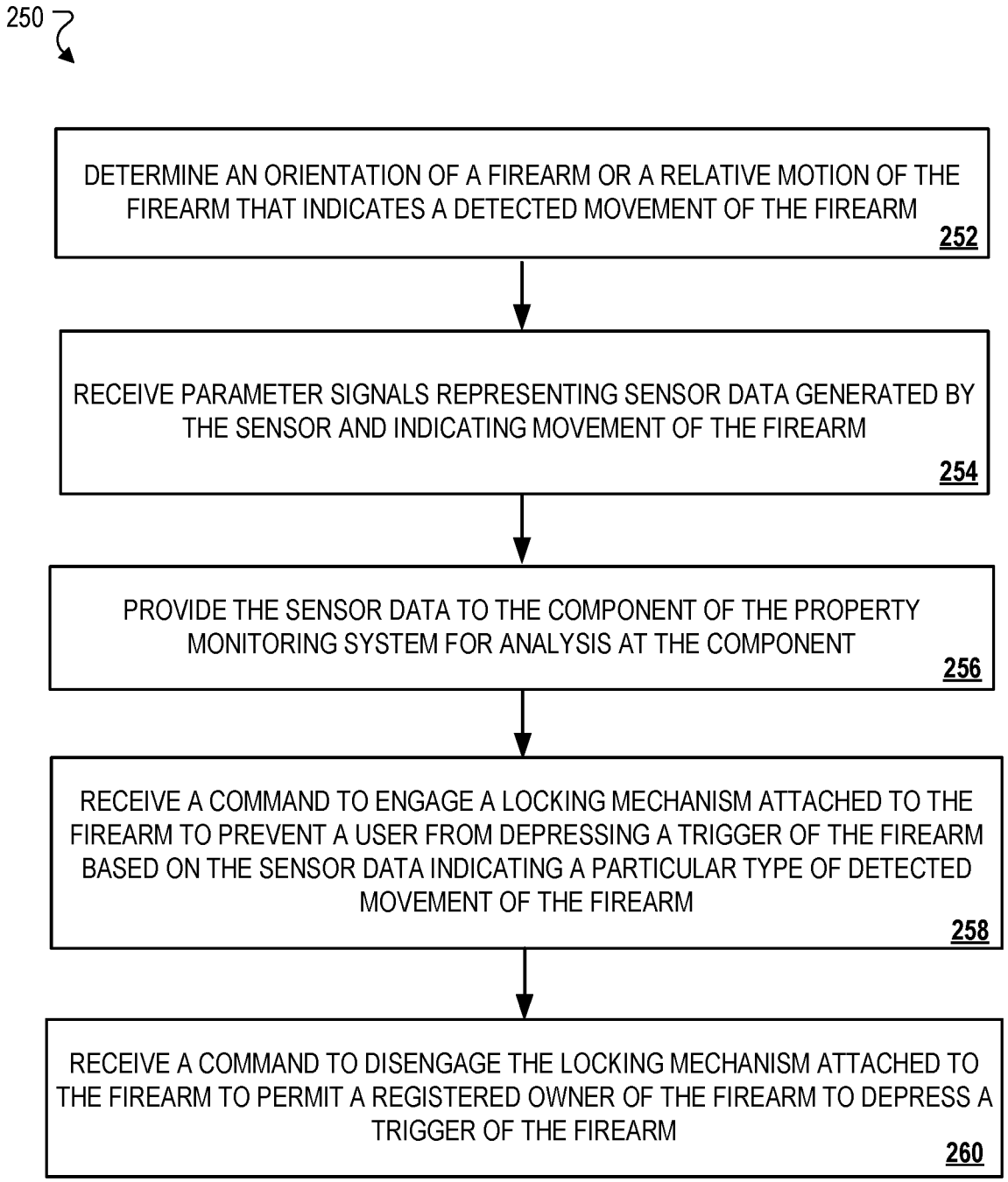
FIG. 3 shows an example process for securing a firearm at a property using the example firearm safety device of FIG. 2.

FIG. 3 shows an example process 250 for securing one or more items at a property 102. In particular, process 250 corresponds to an example user workflow associated with a smart firearm safety device 135 for securing a firearm 132 based on command signals generated using components of system 100. Process 250 can be implemented or performed using the systems described in this document. Descriptions of process 250 may reference one or more of the above-mentioned computing resources of system 100. In some implementations, steps of process 250 are enabled by programmed instructions that are executable by processing devices of the systems described in this document.

Referring now to process 250, a sensor disposed at property 102 determines an orientation of a firearm or a relative motion of the firearm that indicates detected movement of the firearm (252). For example, the sensor 220 can be integrated at the safety device 135 attached to firearm 132. The sensor 220 can be one or more of a gyroscopic sensor for detecting orientation of firearm 132 or an accelerometer for detecting a relative motion of the firearm. The sensor 220 is operable to generate parameter signals representing sensor data 125. The parameter signals can be processed to determine whether the sensed parameter values exceed one or more predefined thresholds so as to indicate a particular type of movement of the firearm 132.

A radio device receives parameter signals representing sensor data generated by the sensor and indicating movement of the firearm (254). For example, radio communication device 210 is a radio device that is operable to receive parameter signals generated by sensor 220. The sensor 220 can be attached to a section of the firearm, such as adjacent to a trigger or trigger guard of the firearm. The parameter signals indicate movement of the firearm 132 located at property 102. The radio device 210 communicates with at least one component of a property monitoring system to receive one or more commands for controlling safety features and locking functions of safety device 135. For example, the radio device 210 may exchange data communications with one or more of the control unit 110, the monitoring server 160, and the safety engine 170 to receive and process commands associated with the safety device 135.

The radio device provides the sensor data to the component of the property monitoring system for analysis at the component (256). For example, the radio device 210 provides the sensor data represented by the parameter signals to the safety engine 170 for analysis at the safety engine.

The radio device receives a first command to engage a locking mechanism attached to the firearm (258). For example, the radio device 210 receives a first command to engage a locking mechanism of the firearm 132 to prevent a particular type of user from depressing a trigger of the firearm based on the sensor data indicating a particular type of detected movement of the firearm. The particular type of user may be an unauthorized user of the firearm such as a minor. In some cases, the particular type of user is an intruder, a trespasser, or a criminal that has recently perpetrated the criminal offense of unlawful entering the property 102 (e.g., breaking and entering to burglarize the property).

The radio device receives a second, different command to disengage the locking mechanism attached to the firearm (260). For example, the radio device 210 receives a second, different command to disengage the locking mechanism of the firearm 132 to permit an authorized user or a registered owner of the firearm to depress a trigger of the firearm, e.g., to discharge the firearm. In some implementations, the second command to disengage the locking mechanism is different than the first command to engage the locking mechanism. For example, the first command to engage the locking mechanism can cause the radio device 210 to automatically engage the locking mechanism of safety device 135, whereas the second command may prompt the monitoring server 160 to require additional user input, such as a simple unlock code to disengage the locking mechanism.

Figure 4:
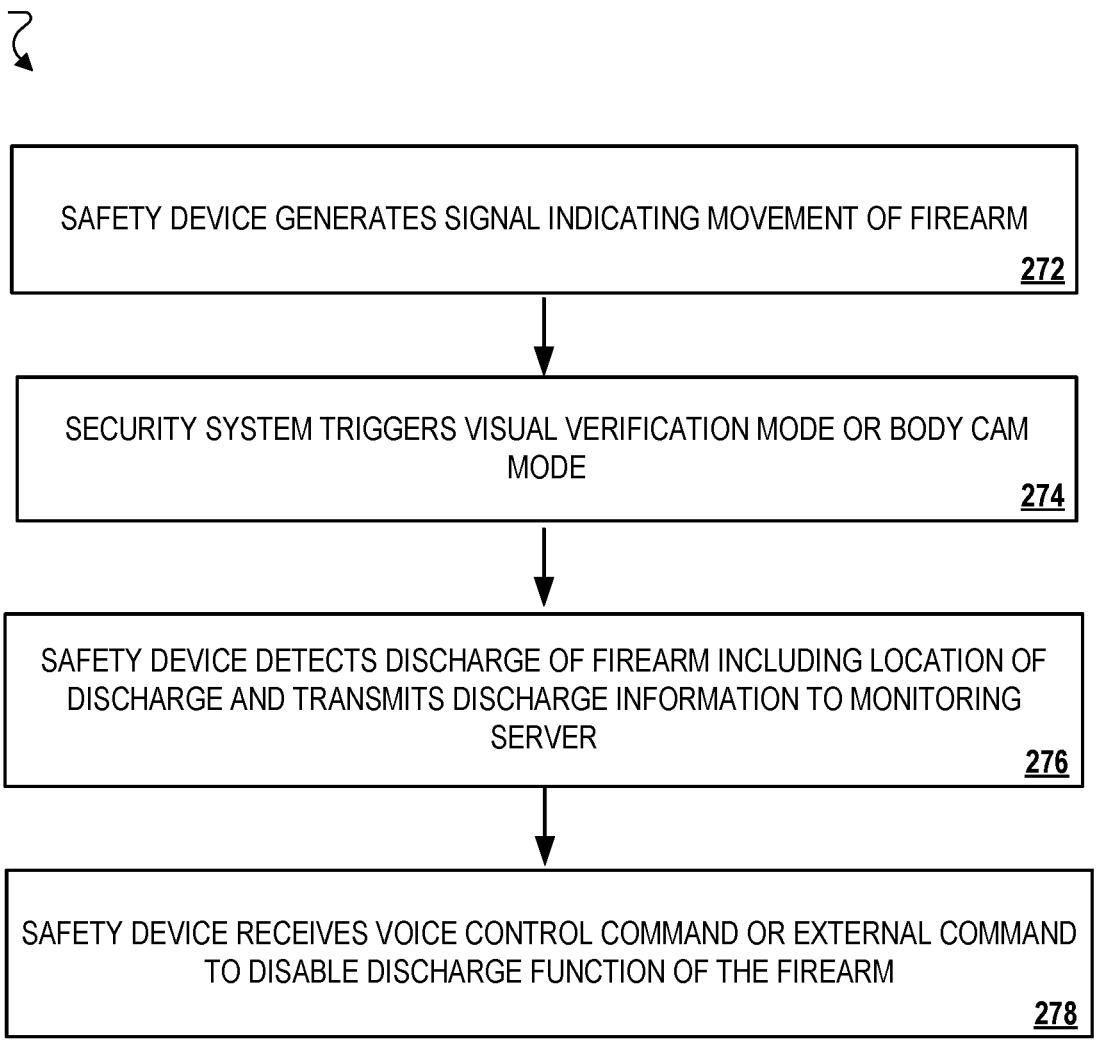
FIG. 4 shows a process related to an example use case for disabling a firearm at a property.

FIG. 4 shows a process 270 related to an example use case for disabling a firearm at a property. Process 270 can be also implemented or performed using the systems described in this document and descriptions of process 270 may reference one or more of the above-mentioned computing resources of system 100.

Referring now to process 270, the safety device 135 attached to the firearm 132 generates one or more signals indicating movement of the firearm at the property (272). For example, the signals may be generated and transmitted using the transceiver 215 based on parameter signals representing sensor data generated by an example accelerometer sensor 220. The safety device 135 can generate a notification or report describing that sensor 220 detects the firearm 132 has been moved by hand.

A security system at the property 102 can trigger a visual verification mode or a body cam mode to obtain visual verification of a user that may be handling the firearm (274). For example, the security system (e.g., the property monitoring system) can determine a location of the detected movement of the firearm 132 and dispatch a drone to the location of the firearm 132 to begin recording or obtaining video footage of the situation. In some implementations, the drone is operable to perform visual verification on the person holding the firearm 132. For example, the drone can determine whether the person is an authorized registered owner of the firearm 132 or an unauthorized user, such as a minor or an unlawful intruder at the property 102.

In some cases, the drone provides the visual video feed to the security system and the security system interacts with the monitoring server 160 and the safety engine 170 to make these determinations. If the security system determines that the person is an unauthorized user, e.g., an unlawful intruder, the security system responds by transmitting a disable command to the safety device 135 to disable the firearm 132, for example by engaging the locking mechanism 205 of the safety device 135. The security system can also respond by automatically notifying the registered owner of the firearm 132 via a push notification message that is sent to the client device 140 of the owner.

When the security system triggers the body cam mode to obtain visual verification of the user handling the firearm 132, the security system immediately transmits a command to cause video cameras at the property 102 to begin obtaining video footage of the situation. If an intruder 109 unlawfully enters the property 102 and is injured by the home owner when the home owner discharges the firearm 132, then law enforcement personnel can easily verify the self-defense nature of the altercation due to video and/or audio data obtained during the incident.

The safety device 135 detects that the firearm 132 has been discharged including details of the discharge, such as the location of the discharge or a number of discharges (276). The safety device 135 reports that multiple discharges have occurred inside the property 102. For example, the safety device 135 can transmit the discharge information to monitoring server 160. In some implementations, the monitoring server 160 determines that the security system at the property 102 is disarmed. In response to this determination, the monitoring server 160 can issue one or more commands to cause the security system to immediately trigger sirens at the property 102. At least one command causes the security system to initiate a voice call (e.g., a two-way voice call) with personnel at a central monitoring station.

The safety device 135 is operable to detect or receive at least one voice control command for disabling a discharge function of the firearm 132 or an external command from the central monitoring station to disable a discharge function of the firearm (278). For example, if an intruder 109 gains possession of the firearm 132, then the home owner can issue a voice control command to disarm the discharge function of the firearm 132.

Figure 5:
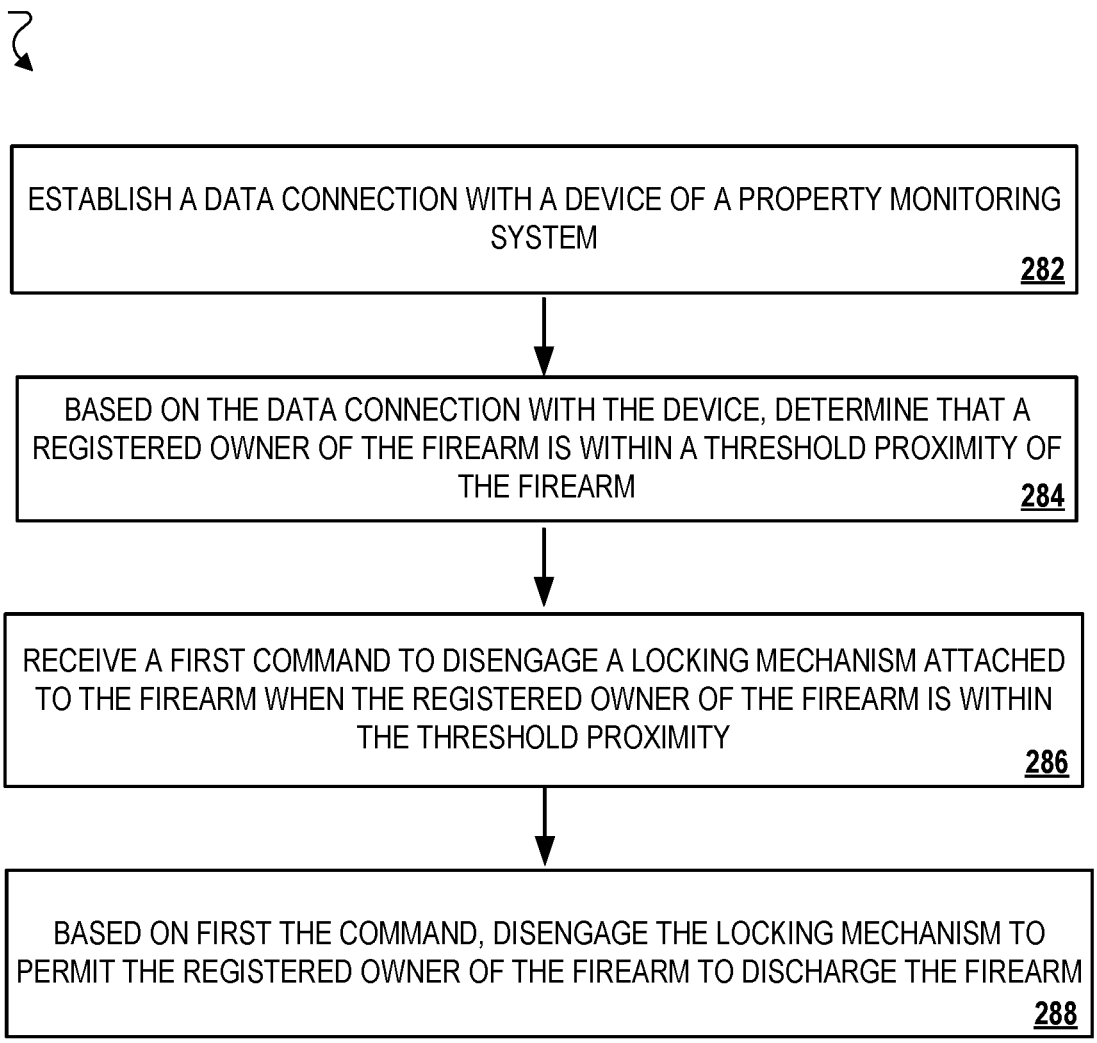
FIG. 5 shows an example process for disengaging a locking mechanism of a firearm to permit discharge of the firearm.

FIG. 5 shows an example process 280 at least for disengaging a locking mechanism of a firearm to permit discharge of the firearm. Process 280 can be also implemented or performed using the systems described in this document and descriptions of process 280 may reference one or more of the above-mentioned computing resources of system 100.

Referring now to process 280, the radio device 210 establishes a data connection with a device of the property monitoring system (282). For example, the radio device 210 can establish a data connection with the client device 140, the monitoring server 160, or both. Based on the data connection with the device, the system 100 determines that a registered owner of the firearm 132 is within a threshold proximity of the firearm (284).

For example, the system 100 can use the sensor 220 of the safety device 135 to process data signals generated by the client device 140, or the monitoring server 160, to determine that the registered owner is within a threshold proximity of the firearm 132. In some implementations, this determination is made based on a Bluetooth connection between the safety device 135 and the client device 140. In some other implementations, the determination is made using sensing or video technology that is operable to determine a distance between the registered owner and the firearm 132 is within some threshold distance. The threshold proximity or distance can be a few feet (e.g., two feet) or a few inches (e.g., ten inches).

The radio device 210 receives a first command to disengage a locking mechanism 205 attached to the firearm 132 when the registered owner of the firearm is within the threshold proximity (286). In some implementations, the safety device 135 includes a Bluetooth (or short wave signal) unlocking function that can be enable such that the locking mechanism 205 is automatically disengaged when an owner's phone is within Bluetooth range of the safety device 135.

The radio device 210 is operable to process parameter signals generated by the sensor 220 and to communicate with the device (e.g., the client device 140) of the property monitoring system to receive one or more authorization commands. For example, the radio device 210 can receive a command to: i) automatically engage the locking mechanism to preclude discharge of the firearm 132 or depressing of the trigger of the firearm based on the parameter signals; or ii) disengage the locking mechanism to permit discharge of the firearm when the registered owner of the firearm is within a threshold proximity of the firearm.

Based on first the command, the safety device 135 disengages the locking mechanism to permit the registered owner of the firearm to discharge the firearm (288). The locking mechanism 205 is disengaged using the sensor 220, for example, based on control signals generated by the sensor 220 in response to the radio device 210 having received the first command. Hence, using the radio device 210 and the sensor 220, the safety device 135 can receive the first command and be configured to automatically disengage the locking mechanism 205 to permit the registered owner to quickly have access to the firearm 132 during an emergency situation.

Figure 6:
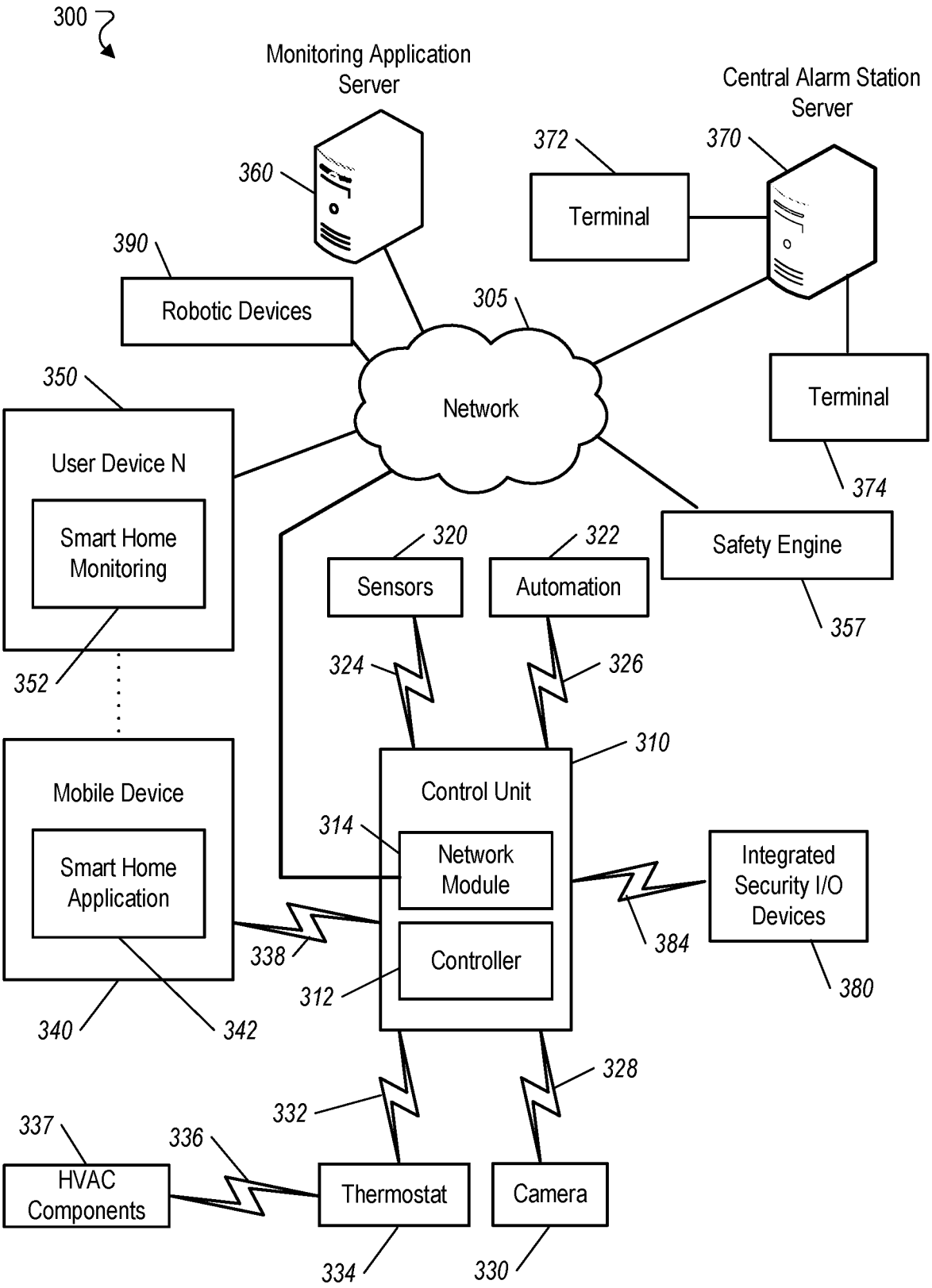
FIG. 6 shows a diagram illustrating an example property monitoring system.

FIG. 6 is a diagram illustrating an example of a property monitoring system 300. The electronic system 300 includes a network 305, a control unit 310, one or more user devices 340 and 350, a monitoring server 360, and a central alarm station server 370. In some examples, the network 305 facilitates communications between the control unit 310, the one or more user devices 340 and 350, the monitoring server 360, and the central alarm station server 370.

The network 305 is configured to enable exchange of electronic communications between devices connected to the network 305. For example, the network 305 may be configured to enable exchange of electronic communications between the control unit 310, the one or more user devices 340 and 350, the monitoring server 360, and the central alarm station server 370. The network 305 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. Network 305 may include multiple networks or subnetworks, each of which may include, for example, a wired or wireless data pathway. The network 305 may include a circuit-switched network, a packet-switched data network, or any other network able to carry electronic communications (e.g., data or voice communications). For example, the network 305 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 305 may include one or more networks that include wireless data channels and wireless voice channels. The network 305 may be a wireless network, a broadband network, or a combination of networks including a wireless network and a broadband network.

The control unit 310 includes a controller 312 and a network module 314. The controller 312 is configured to control a control unit monitoring system (e.g., a control unit system) that includes the control unit 310. In some examples, the controller 312 may include a processor or other control circuitry configured to execute instructions of a program that controls operation of a control unit system. In these examples, the controller 312 may be configured to receive input from sensors, flow meters, or other devices included in the control unit system and control operations of devices included in the household (e.g., speakers, lights, doors, etc.). For example, the controller 312 may be configured to control operation of the network module 314 included in the control unit 310.

The network module 314 is a communication device configured to exchange communications over the network 305. The network module 314 may be a wireless communication module configured to exchange wireless communications over the network 305. For example, the network module 314 may be a wireless communication device configured to exchange communications over a wireless data channel and a wireless voice channel. In this example, the network module 314 may transmit alarm data over a wireless data channel and establish a two-way voice communication session over a wireless voice channel. The wireless communication device may include one or more of a LTE module, a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module 314 also may be a wired communication module configured to exchange communications over the network 305 using a wired connection. For instance, the network module 314 may be a modem, a network interface card, or another type of network interface device. The network module 314 may be an Ethernet network card configured to enable the control unit 310 to communicate over a local area network and/or the Internet. The network module 314 also may be a voice band modem configured to enable the alarm panel to communicate over the telephone lines of Plain Old Telephone Systems (POTS).

The control unit system that includes the control unit 310 includes one or more sensors. For example, the monitoring system may include multiple sensors 320. The sensors 320 may include a lock sensor, a contact sensor, a motion sensor, or any other type of sensor included in a control unit system. The sensors 320 also may include an environmental sensor, such as a temperature sensor, a water sensor, a rain sensor, a wind sensor, a light sensor, a smoke detector, a carbon monoxide detector, an air quality sensor, etc. The sensors 320 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the health monitoring sensor can be a wearable sensor that attaches to a user in the home. The health monitoring sensor can collect various health data, including pulse, heart-rate, respiration rate, sugar or glucose level, bodily temperature, or motion data.

The sensors 320 can also include a radio-frequency identification (RFID) sensor that identifies a particular article that includes a pre-assigned RFID tag.

The control unit 310 communicates with the home automation controls 322 and a camera 330 to perform monitoring. The home automation controls 322 are connected to one or more devices that enable automation of actions in the home. For instance, the home automation controls 322 may be connected to one or more lighting systems and may be configured to control operation of the one or more lighting systems. Also, the home automation controls 322 may be connected to one or more electronic locks at the home and may be configured to control operation of the one or more electronic locks (e.g., control Z-Wave locks using wireless communications in the Z-Wave protocol). Further, the home automation controls 322 may be connected to one or more appliances at the home and may be configured to control operation of the one or more appliances. The home automation controls 322 may include multiple modules that are each specific to the type of device being controlled in an automated manner. The home automation controls 322 may control the one or more devices based on commands received from the control unit 310. For instance, the home automation controls 322 may cause a lighting system to illuminate an area to provide a better image of the area when captured by a camera 330.

The camera 330 may be a video/photographic camera or other type of optical sensing device configured to capture images. For instance, the camera 330 may be configured to capture images of an area within a building or home monitored by the control unit 310. The camera 330 may be configured to capture single, static images of the area and also video images of the area in which multiple images of the area are captured at a relatively high frequency (e.g., thirty images per second). The camera 330 may be controlled based on commands received from the control unit 310.

The camera 330 may be triggered by several different types of techniques. For instance, a Passive Infra-Red (PIR) motion sensor may be built into the camera 330 and used to trigger the camera 330 to capture one or more images when motion is detected. The camera 330 also may include a microwave motion sensor built into the camera and used to trigger the camera 330 to capture one or more images when motion is detected. The camera 330 may have a "normally open" or "normally closed" digital input that can trigger capture of one or more images when external sensors (e.g., the sensors 320, PIR, door/window, etc.) detect motion or other events. In some implementations, the camera 330 receives a command to capture an image when external devices detect motion or another potential alarm event. The camera 330 may receive the command from the controller 312 or directly from one of the sensors 320.

In some examples, the camera 330 triggers integrated or external illuminators (e.g., Infra-Red, Z-wave controlled "white" lights, lights controlled by the home automation controls 322, etc.) to improve image quality when the scene is dark. An integrated or separate light sensor may be used to determine if illumination is desired and may result in increased image quality.

The camera 330 may be programmed with any combination of time/day schedules, system "arming state", or other variables to determine whether images should be captured or not when triggers occur. The camera 330 may enter a low-power mode when not capturing images. In this case, the camera 330 may wake periodically to check for inbound messages from the controller 312. The camera 330 may be powered by internal, replaceable batteries if located remotely from the control unit 310. The camera 330 may employ a small solar cell to recharge the battery when light is available. Alternatively, the camera 330 may be powered by the controller's 312 power supply if the camera 330 is co-located with the controller 312.

In some implementations, the camera 330 communicates directly with the monitoring server 360 over the Internet. In these implementations, image data captured by the camera 330 does not pass through the control unit 310 and the camera 330 receives commands related to operation from the monitoring server 360.

The system 300 also includes thermostat 334 to perform dynamic environmental control at the home. The thermostat 334 is configured to monitor temperature and/or energy consumption of an HVAC system associated with the thermostat 334, and is further configured to provide control of environmental (e.g., temperature) settings. In some implementations, the thermostat 334 can additionally or alternatively receive data relating to activity at a home and/or environmental data at a home, e.g., at various locations indoors and outdoors at the home. The thermostat 334 can directly measure energy consumption of the HVAC system associated with the thermostat, or can estimate energy consumption of the HVAC system associated with the thermostat 334, for example, based on detected usage of one or more components of the HVAC system associated with the thermostat 334. The thermostat 334 can communicate temperature and/or energy monitoring information to or from the control unit 310 and can control the environmental (e.g., temperature) settings based on commands received from the control unit 310.

In some implementations, the thermostat 334 is a dynamically programmable thermostat and can be integrated with the control unit 310. For example, the dynamically programmable thermostat 334 can include the control unit 310, e.g., as an internal component to the dynamically programmable thermostat 334. In addition, the control unit 310 can be a gateway device that communicates with the dynamically programmable thermostat 334. In some implementations, the thermostat 334 is controlled via one or more home automation controls 322.

A module 337 is connected to one or more components of an HVAC system associated with a home, and is configured to control operation of the one or more components of the HVAC system. In some implementations, the module 337 is also configured to monitor energy consumption of the HVAC system components, for example, by directly measuring the energy consumption of the HVAC system components or by estimating the energy usage of the one or more HVAC system components based on detecting usage of components of the HVAC system. The module 337 can communicate energy monitoring information and the state of the HVAC system components to the thermostat 334 and can control the one or more components of the HVAC system based on commands received from the thermostat 334.

The system 300 includes one or more safety engines 357. Each of the one or more safety engine 357 connects to control unit 310, e.g., through network 305. The safety engines 357 can be computing devices (e.g., a computer, microcontroller, FPGA, ASIC, or other device capable of electronic computation) capable of receiving data related to the sensors 320 and communicating electronically with the monitoring system control unit 310 and monitoring server 360.

The safety engine 357 receives data from one or more sensors 320. In some examples, the safety engine 357 can be used to determine or indicate whether a locking mechanism is engaged or disengaged based on data generated by sensors 320 (e.g., data from sensor 320 describing motion, movement, acceleration/velocity, orientation, and other parameters). The safety engine 357 can receive data from the one or more sensors 320 through any combination of wired and/or wireless data links. For example, the safety engine 357 can receive sensor data via a Bluetooth, Bluetooth LE, Z-wave, or Zigbee data link.

The safety engine 357 communicates electronically with the control unit 310. For example, the safety engine 357 can send data related to the sensors 320 to the control unit 310 and receive commands related to determining a state of safety device 135 and locking mechanism 205 based on data from the sensors 320. In some examples, the safety engine 357 processes or generates sensor signal data, for signals emitted by the sensors 320, prior to sending it to the control unit 310. The sensor signal data can include information that indicates a user 108 has retrieved a firearm 132 or have discharged the firearm 132.

In some examples, the system 300 further includes one or more robotic devices 390. The robotic devices 390 may be any type of robots that are capable of moving and taking actions that assist in home monitoring. For example, the robotic devices 390 may include drones that are capable of moving throughout a home based on automated control technology and/or user input control provided by a user. In this example, the drones may be able to fly, roll, walk, or otherwise move about the home. The drones may include helicopter type devices (e.g., quad copters), rolling helicopter type devices (e.g., roller copter devices that can fly and also roll along the ground, walls, or ceiling) and land vehicle type devices (e.g., automated cars that drive around a home). In some cases, the robotic devices 390 may be devices that are intended for other purposes and merely associated with the system 300 for use in appropriate circumstances. For instance, a robotic vacuum cleaner device may be associated with the monitoring system 300 as one of the robotic devices 390 and may be controlled to take action responsive to monitoring system events.

In some examples, the robotic devices 390 automatically navigate within a home. In these examples, the robotic devices 390 include sensors and control processors that guide movement of the robotic devices 390 within the home. For instance, the robotic devices 390 may navigate within the home using one or more cameras, one or more proximity sensors, one or more gyroscopes, one or more accelerometers, one or more magnetometers, a global positioning system (GPS) unit, an altimeter, one or more sonar or laser sensors, and/or any other types of sensors that aid in navigation about a space. The robotic devices 390 may include control processors that process output from the various sensors and control the robotic devices 390 to move along a path that reaches the desired destination and avoids obstacles. In this regard, the control processors detect walls or other obstacles in the home and guide movement of the robotic devices 390 in a manner that avoids the walls and other obstacles.

In addition, the robotic devices 390 may store data that describes attributes of the home. For instance, the robotic devices 390 may store a floorplan and/or a three-dimensional model of the home that enables the robotic devices 390 to navigate the home. During initial configuration, the robotic devices 390 may receive the data describing attributes of the home, determine a frame of reference to the data (e.g., a home or reference location in the home), and navigate the home based on the frame of reference and the data describing attributes of the home. Further, initial configuration of the robotic devices 390 also may include learning of one or more navigation patterns in which a user provides input to control the robotic devices 390 to perform a specific navigation action (e.g., fly to an upstairs bedroom and spin around while capturing video and then return to a home charging base). In this regard, the robotic devices 390 may learn and store the navigation patterns such that the robotic devices 390 may automatically repeat the specific navigation actions upon a later request.

In some examples, the robotic devices 390 may include data capture and recording devices. In these examples, the robotic devices 390 may include one or more cameras, one or more motion sensors, one or more microphones, one or more biometric data collection tools, one or more temperature sensors, one or more humidity sensors, one or more air flow sensors, and/or any other types of sensors that may be useful in capturing monitoring data related to the home and users in the home. The one or more biometric data collection tools may be configured to collect biometric samples of a person in the home with or without contact of the person. For instance, the biometric data collection tools may include a fingerprint scanner, a hair sample collection tool, a skin cell collection tool, and/or any other tool that allows the robotic devices 390 to take and store a biometric sample that can be used to identify the person (e.g., a biometric sample with DNA that can be used for DNA testing).

In some implementations, the robotic devices 390 may include output devices. In these implementations, the robotic devices 390 may include one or more displays, one or more speakers, and/or any type of output devices that allow the robotic devices 390 to communicate information to a nearby user.

The robotic devices 390 also may include a communication module that enables the robotic devices 390 to communicate with the control unit 310, each other, and/or other devices. The communication module may be a wireless communication module that allows the robotic devices 390 to communicate wirelessly. For instance, the communication module may be a Wi-Fi module that enables the robotic devices 390 to communicate over a local wireless network at the home. The communication module further may be a 900 MHz wireless communication module that enables the robotic devices 390 to communicate directly with the control unit 310. Other types of short-range wireless communication protocols, such as Bluetooth, Bluetooth LE, Z-wave, Zigbee, etc., may be used to allow the robotic devices 390 to communicate with other devices in the home. In some implementations, the robotic devices 390 may communicate with each other or with other devices of the system 300 through the network 305.

The robotic devices 390 further may include processor and storage capabilities. The robotic devices 390 may include any suitable processing devices that enable the robotic devices 390 to operate applications and perform the actions described throughout this disclosure. In addition, the robotic devices 390 may include solid state electronic storage that enables the robotic devices 390 to store applications, configuration data, collected sensor data, and/or any other type of information available to the robotic devices 390.

The robotic devices 390 are associated with one or more charging stations. The charging stations may be located at predefined home base or reference locations in the home. The robotic devices 390 may be configured to navigate to the charging stations after completion of tasks needed to be performed for the monitoring system 300. For instance, after completion of a monitoring operation or upon instruction by the control unit 310, the robotic devices 390 may be configured to automatically fly to and land on one of the charging stations. In this regard, the robotic devices 390 may automatically maintain a fully charged battery in a state in which the robotic devices 390 are ready for use by the monitoring system 300.

The charging stations may be contact based charging stations and/or wireless charging stations. For contact based charging stations, the robotic devices 390 may have readily accessible points of contact that the robotic devices 390 are capable of positioning and mating with a corresponding contact on the charging station. For instance, a helicopter type robotic device may have an electronic contact on a portion of its landing gear that rests on and mates with an electronic pad of a charging station when the helicopter type robotic device lands on the charging station. The electronic contact on the robotic device may include a cover that opens to expose the electronic contact when the robotic device is charging and closes to cover and insulate the electronic contact when the robotic device is in operation.

For wireless charging stations, the robotic devices 390 may charge through a wireless exchange of power. In these cases, the robotic devices 390 need only locate themselves closely enough to the wireless charging stations for the wireless exchange of power to occur. In this regard, the positioning needed to land at a predefined home base or reference location in the home may be less precise than with a contact based charging station. Based on the robotic devices 390 landing at a wireless charging station, the wireless charging station outputs a wireless signal that the robotic devices 390 receive and convert to a power signal that charges a battery maintained on the robotic devices 390.

In some implementations, each of the robotic devices 390 has a corresponding and assigned charging station such that the number of robotic devices 390 equals the number of charging stations. In these implementations, the robotic devices 390 always navigate to the specific charging station assigned to that robotic device. For instance, a first robotic device may always use a first charging station and a second robotic device may always use a second charging station.

In some examples, the robotic devices 390 may share charging stations. For instance, the robotic devices 390 may use one or more community charging stations that are capable of charging multiple robotic devices 390. The community charging station may be configured to charge multiple robotic devices 390 in parallel. The community charging station may be configured to charge multiple robotic devices 390 in serial such that the multiple robotic devices 390 take turns charging and, when fully charged, return to a predefined home base or reference location in the home that is not associated with a charger. The number of community charging stations may be less than the number of robotic devices 390.

Also, the charging stations may not be assigned to specific robotic devices 390 and may be capable of charging any of the robotic devices 390. In this regard, the robotic devices 390 may use any suitable, unoccupied charging station when not in use. For instance, when one of the robotic devices 390 has completed an operation or is in need of battery charge, the control unit 310 references a stored table of the occupancy status of each charging station and instructs the robotic device to navigate to the nearest charging station that is unoccupied.

The system 300 further includes one or more integrated security devices 380. The one or more integrated security devices may include any type of device used to provide alerts based on received sensor data. For instance, the one or more control units 310 may provide one or more alerts to the one or more integrated security input/output devices 380. Additionally, the one or more control units 310 may receive one or more sensor data from the sensors 320 and determine whether to provide an alert to the one or more integrated security input/output devices 380.

The sensors 320, the home automation controls 322, the camera 330, the thermostat 334, and the integrated security devices 380 may communicate with the controller 312 over communication links 324, 326, 328, 332, 338, and 384. The communication links 324, 326, 328, 332, 338, and 384 may be a wired or wireless data pathway configured to transmit signals from the sensors 320, the home automation controls 322, the camera 330, the thermostat 334, and the integrated security devices 380 to the controller 312. The sensors 320, the home automation controls 322, the camera 330, the thermostat 334, and the integrated security devices 380 may continuously transmit sensed values to the controller 312, periodically transmit sensed values to the controller 312, or transmit sensed values to the controller 312 in response to a change in a sensed value.

The communication links 324, 326, 328, 332, 338, and 384 may include a local network. The sensors 320, the home automation controls 322, the camera 330, the thermostat 334, and the integrated security devices 380, and the controller 312 may exchange data and commands over the local network. The local network may include 802.11 "Wi-Fi" wireless Ethernet (e.g., using low-power Wi-Fi chipsets), Z-Wave, Zigbee, Bluetooth, "Homeplug" or other "Powerline" networks that operate over AC wiring, and a Category 5 (CATS) or Category 6 (CAT6) wired Ethernet network. The local network may be a mesh network constructed based on the devices connected to the mesh network.

The monitoring server 360 is an electronic device configured to provide monitoring services by exchanging electronic communications with the control unit 310, the one or more user devices 340 and 350, and the central alarm station server 370 over the network 305. For example, the monitoring server 360 may be configured to monitor events (e.g., alarm events) generated by the control unit 310. In this example, the monitoring server 360 may exchange electronic communications with the network module 314 included in the control unit 310 to receive information regarding events (e.g., alerts) detected by the control unit 310. The monitoring server 360 also may receive information regarding events (e.g., alerts) from the one or more user devices 340 and 350.

In some examples, the monitoring server 360 may route alert data received from the network module 314 or the one or more user devices 340 and 350 to the central alarm station server 370. For example, the monitoring server 360 may transmit the alert data to the central alarm station server 370 over the network 305.

The monitoring server 360 may store sensor and image data received from the monitoring system and perform analysis of sensor and image data received from the monitoring system. Based on the analysis, the monitoring server 360 may communicate with and control aspects of the control unit 310 or the one or more user devices 340 and 350.

The monitoring server 360 may provide various monitoring services to the system 300. For example, the monitoring server 360 may analyze the sensor, image, and other data to determine an activity pattern of a resident of the home monitored by the system 300. In some implementations, the monitoring server 360 may analyze the data for alarm conditions or may determine and perform actions at the home by issuing commands to one or more of the controls 322, possibly through the control unit 310.

The central alarm station server 370 is an electronic device configured to provide alarm monitoring service by exchanging communications with the control unit 310, the one or more mobile devices 340 and 350, and the monitoring server 360 over the network 305. For example, the central alarm station server 370 may be configured to monitor alerting events generated by the control unit 310. In this example, the central alarm station server 370 may exchange communications with the network module 314 included in the control unit 310 to receive information regarding alerting events detected by the control unit 310. The central alarm station server 370 also may receive information regarding alerting events from the one or more mobile devices 340 and 350 and/or the monitoring server 360.

The central alarm station server 370 is connected to multiple terminals 372 and 374. The terminals 372 and 374 may be used by operators to process alerting events. For example, the central alarm station server 370 may route alerting data to the terminals 372 and 374 to enable an operator to process the alerting data. The terminals 372 and 374 may include general-purpose computers (e.g., desktop personal computers, workstations, or laptop computers) that are configured to receive alerting data from a server in the central alarm station server 370 and render a display of information based on the alerting data. For instance, the controller 312 may control the network module 314 to transmit, to the central alarm station server 370, alerting data indicating that a sensor 320 detected motion from a motion sensor via the sensors 320. The central alarm station server 370 may receive the alerting data and route the alerting data to the terminal 372 for processing by an operator associated with the terminal 372. The terminal 372 may render a display to the operator that includes information associated with the alerting event (e.g., the lock sensor data, the motion sensor data, the contact sensor data, etc.) and the operator may handle the alerting event based on the displayed information.

In some implementations, the terminals 372 and 374 may be mobile devices or devices designed for a specific function. Although FIG. 6 illustrates two terminals for brevity, actual implementations may include more (and, perhaps, many more) terminals.

The one or more authorized user devices 340 and 350 are devices that host and display user interfaces. For instance, the user device 340 is a mobile device that hosts or runs one or more native applications (e.g., the smart home application 342). The user device 340 may be a cellular phone or a non-cellular locally networked device with a display. The user device 340 may include a cell phone, a smart phone, a tablet PC, a personal digital assistant ("PDA"), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. The user device 340 may perform functions unrelated to the monitoring system, such as placing personal telephone calls, playing music, playing video, displaying pictures, browsing the Internet, maintaining an electronic calendar, etc.

The user device 340 includes a smart home application 342. The smart home application 342 refers to a software/firmware program running on the corresponding mobile device that enables the user interface and features described throughout. The user device 340 may load or install the smart home application 342 based on data received over a network or data received from local media. The smart home application 342 runs on mobile devices platforms, such as iPhone, iPod touch, Blackberry, Google Android, Windows Mobile, etc. The smart home application 342 enables the user device 340 to receive and process image and sensor data from the monitoring system.

The user device 350 may be a general-purpose computer (e.g., a desktop personal computer, a workstation, or a laptop computer) that is configured to communicate with the monitoring server 360 and/or the control unit 310 over the network 305. The user device 350 may be configured to display a smart home user interface 352 that is generated by the user device 350 or generated by the monitoring server 360. For example, the user device 350 may be configured to display a user interface (e.g., a web page) provided by the monitoring server 360 that enables a user to perceive images captured by the camera 330 and/or reports related to the monitoring system. Although FIG. 6 illustrates two user devices for brevity, actual implementations may include more (and, perhaps, many more) or fewer user devices.

In some implementations, the one or more user devices 340 and 350 communicate with and receive monitoring system data from the control unit 310 using the communication link 338. For instance, the one or more user devices 340 and 350 may communicate with the control unit 310 using various local wireless protocols such as Wi-Fi, Bluetooth, Z-wave, Zigbee, HomePlug (ethernet over power line), or wired protocols such as Ethernet and USB, to connect the one or more user devices 340 and 350 to local security and automation equipment. The one or more user devices 340 and 350 may connect locally to the monitoring system and its sensors and other devices. The local connection may improve the speed of status and control communications because communicating through the network 305 with a remote server (e.g., the monitoring server 360) may be significantly slower.

Although the one or more user devices 340 and 350 are shown as communicating with the control unit 310, the one or more user devices 340 and 350 may communicate directly with the sensors and other devices controlled by the control unit 310. In some implementations, the one or more user devices 340 and 350 replace the control unit 310 and perform the functions of the control unit 310 for local monitoring and long range/offsite communication.

In other implementations, the one or more user devices 340 and 350 receive monitoring system data captured by the control unit 310 through the network 305. The one or more user devices 340, 350 may receive the data from the control unit 310 through the network 305 or the monitoring server 360 may relay data received from the control unit 310 to the one or more user devices 340 and 350 through the network 305. In this regard, the monitoring server 360 may facilitate communication between the one or more user devices 340 and 350 and the monitoring system.

In some implementations, the one or more user devices 340 and 350 may be configured to switch whether the one or more user devices 340 and 350 communicate with the control unit 310 directly (e.g., through link 338) or through the monitoring server 360 (e.g., through network 305) based on a location of the one or more user devices 340 and 350. For instance, when the one or more user devices 340 and 350 are located close to the control unit 310 and in range to communicate directly with the control unit 310, the one or more user devices 340 and 350 use direct communication. When the one or more user devices 340 and 350 are located far from the control unit 310 and not in range to communicate directly with the control unit 310, the one or more user devices 340 and 350 use communication through the monitoring server 360.

Although the one or more user devices 340 and 350 are shown as being connected to the network 305, in some implementations, the one or more user devices 340 and 350 are not connected to the network 305. In these implementations, the one or more user devices 340 and 350 communicate directly with one or more of the monitoring system components and no network (e.g., Internet) connection or reliance on remote servers is needed.

In some implementations, the one or more user devices 340 and 350 are used in conjunction with only local sensors and/or local devices in a house. In these implementations, the system 300 includes the one or more user devices 340 and 350, the sensors 320, the home automation controls 322, the camera 330, the robotic devices 390, and the safety engine 357. The one or more user devices 340 and 350 receive data directly from the sensors 320, the home automation controls 322, the camera 330, the robotic devices 390, and the safety engine 357 and sends data directly to the sensors 320, the home automation controls 322, the camera 330, the robotic devices 390, and the safety engine 357. The one or more user devices 340, 350 provide the appropriate interfaces/processing to provide visual surveillance and reporting.

In other implementations, the system 300 further includes network 305 and the sensors 320, the home automation controls 322, the camera 330, the thermostat 334, the robotic devices 390, and the safety engine 357 are configured to communicate sensor and image data to the one or more user devices 340 and 350 over network 305 (e.g., the Internet, cellular network, etc.). In yet another implementation, the sensors 320, the home automation controls 322, the camera 330, the thermostat 334, the robotic devices 390, and the safety engine 357 (or a component, such as a bridge/router) are intelligent enough to change the communication pathway from a direct local pathway when the one or more user devices 340 and 350 are in close physical proximity to the sensors 320, the home automation controls 322, the camera 330, the thermostat 334, the robotic devices 390, and the safety engine 357 to a pathway over network 305 when the one or more user devices 340 and 350 are farther from the sensors 320, the home automation controls 322, the camera 330, the thermostat 334, the robotic devices 390, and the safety engine.

In some examples, the system leverages GPS information from the one or more user devices 340 and 350 to determine whether the one or more user devices 340 and 350 are close enough to the sensors 320, the home automation controls 322, the camera 330, the thermostat 334, the robotic devices 390, and the safety engine 357 to use the direct local pathway or whether the one or more user devices 340 and 350 are far enough from the sensors 320, the home automation controls 322, the camera 330, the thermostat 334, the robotic devices 390, and the safety engine 357 that the pathway over network 305 is required.

In other examples, the system leverages status communications (e.g., pinging) between the one or more user devices 340 and 350 and the sensors 320, the home automation controls 322, the camera 330, the thermostat 334, the robotic devices 390, and the safety engine 357 to determine whether communication using the direct local pathway is possible. If communication using the direct local pathway is possible, the one or more user devices 340 and 350 communicate with the sensors 320, the home automation controls 322, the camera 330, the thermostat 334, the robotic devices 390, and the safety engine 357 using the direct local pathway. If communication using the direct local pathway is not possible, the one or more user devices 340 and 350 communicate with the sensors 320, the home automation controls 322, the camera 330, the thermostat 334, the robotic devices 390, and the safety engine 357 using the pathway over network 305.

In some implementations, the system 300 provides end users with access to images captured by the camera 330 to aid in decision making. The system 300 may transmit the images captured by the camera 330 over a wireless WAN network to the user devices 340 and 350. Because transmission over a wireless WAN network may be relatively expensive, the system 300 can use several techniques to reduce costs while providing access to significant levels of useful visual information (e.g., compressing data, down-sampling data, sending data only over inexpensive LAN connections, or other techniques).

In some implementations, a state of the monitoring system and other events sensed by the monitoring system may be used to enable/disable video/image recording devices (e.g., the camera 330). In these implementations, the camera 330 may be set to capture images on a periodic basis when the alarm system is armed in an "away" state, but set not to capture images when the alarm system is armed in a "home" state or disarmed. In addition, the camera 330 may be triggered to begin capturing images when the alarm system detects an event, such as an alarm event, a door-opening event for a door that leads to an area within a field of view of the camera 330, or motion in the area within the field of view of the camera 330. In other implementations, the camera 330 may capture images continuously, but the captured images may be stored or transmitted over a network when needed.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device.

Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory.

Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially designed ASICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. A method implemented using a safety device that attaches to a firearm, the method comprising:

determining that a locking mechanism of the safety device is engaged to preclude depressing a trigger of the firearm;

detecting a parameter signal indicating an alarm condition at a property that includes the safety device; and based on the parameter signal, automatically disengaging the locking mechanism when a registered owner of the firearm is within a threshold proximity of the firearm.

2. The method of claim 1, wherein determining that a locking mechanism of the safety device is engaged comprises:

determining, at the safety device, that the locking mechanism is engaged, wherein the determining is performed at the safety device using a radio device integrated in the safety device.

3. The method of claim 2, wherein detecting a parameter signal indicating an alarm condition at the property comprises:

detecting, at the radio device, the parameter signal, wherein the detecting is performed using a transceiver integrated in the radio device.

4. The method of claim 3, wherein detecting a parameter signal indicating an alarm condition at the property comprises:

detecting the parameter signal at a monitoring server of a property monitoring system configured to monitor the property.

5. The method of claim 4, comprising:

generating a command to disengage the locking mechanism in response to detecting the parameter signal; and automatically disengaging the locking mechanism in response to processing the command, wherein automatically disengaging the locking mechanism permits an authorized user of the firearm to discharge the firearm when the registered owner or the authorized user is within the threshold proximity of the firearm.

6. The method of claim 5, wherein the command is generated by the monitoring server and processed by the radio device.

7. The method of claim 5, wherein the command is generated and processed at the safety device by the radio device.

8. The method of claim 5, wherein generating the command comprises:

detecting a Bluetooth connection between the safety device and a client device of the registered owner of the firearm; and transmitting the command to the safety device using the Bluetooth connection.

9. The method of claim 5, wherein generating the command comprises:

detecting, by a biometric scanning device, a biometric attribute of an individual;

determining, by the radio device, that the individual is authorized to discharge the firearm based on the biometric attribute; and generating the command in response to determining that the individual is authorized to discharge the firearm.

10. The method of claim 9, wherein the biometric scanning device is integrated at the safety device as a sensor of the radio device.

11. A system for operating a safety device that attaches to a firearm, the system comprising a processor and a non-transitory machine-readable storage device storing instructions that are executable by the processor to cause performance of operations comprising:

determining that a locking mechanism of the safety device is engaged to preclude depressing a trigger of the firearm;

detecting a parameter signal indicating an alarm condition at a property that includes the safety device; and based on the parameter signal, automatically disengaging the locking mechanism when a registered owner of the firearm is within a threshold proximity of the firearm.

12. The system of claim 11, wherein determining that a locking mechanism of the safety device is engaged comprises:

determining, at the safety device, that the locking mechanism is engaged, wherein the determining is performed at the safety device using a radio device integrated in the safety device.

13. The system of claim 12, wherein detecting a parameter signal indicating an alarm condition at the property comprises:

detecting, at the radio device, the parameter signal, wherein the detecting is performed using a transceiver integrated in the radio device.

14. The system of claim 13, wherein detecting a parameter signal indicating an alarm condition at the property comprises:

detecting the parameter signal at a monitoring server of a property monitoring system configured to monitor the property.

15. The system of claim 14, wherein the operations comprise:

generating a command to disengage the locking mechanism in response to detecting the parameter signal; and automatically disengaging the locking mechanism in response to processing the command, wherein automatically disengaging the locking mechanism permits an authorized user of the firearm to discharge the firearm when the registered owner or the authorized user is within the threshold proximity of the firearm.

16. The system of claim 15, wherein the command is generated by the monitoring server and processed by the radio device.

17. The system of claim 15, wherein the command is generated and processed by the radio device.

18. The system of claim 15, wherein generating the command comprises:

detecting a Bluetooth connection between the safety device and a client device of the registered owner of the firearm; and transmitting the command to the safety device using the Bluetooth connection.

19. The system of claim 15, wherein generating the command comprises:

detecting, by a biometric scanning device, a biometric attribute of an individual;

determining, by the radio device, that the individual is the registered owner or is authorized to discharge the firearm based on the biometric attribute; and generating the command in response to determining that the individual is authorized to discharge the firearm.

20. The system of claim 19, wherein the biometric scanning device is integrated at the safety device as a sensor of the radio device.

* * * * *